United States Patent [19]

Gellert et al.

[11] Patent Number: 5,006,758

[45] Date of Patent: Apr. 9, 1991

[54] HIGH-POWER RADIATOR

[75] Inventors: Bernd Gellert, Wettingen; Ulrich Kogelschatz, Hausen, both of Switzerland

[73] Assignee: Asea Brown Boveri Ltd., Baden, Switzerland

[21] Appl. No.: 417,473

[22] Filed: Oct. 5, 1989

[30] Foreign Application Priority Data

Oct. 10, 1988 [CH] Switzerland ..... 3778/88

[51] Int. Cl.[5] ..... H01J 61/06

[52] U.S. Cl. ..... 313/634; 313/607; 313/609; 313/234

[58] Field of Search ..... 313/22, 23, 24, 35, 313/36, 39, 609, 610, 631, 634, 635, 607, 234

[56] References Cited

U.S. PATENT DOCUMENTS 4,945,290 7/1990 Eliasson et al. ..... 313/607 X

FOREIGN PATENT DOCUMENTS 0254111 1/1988 European Pat. Off. .
152887 1/1988 Switzerland .

OTHER PUBLICATIONS

Gesellschaft Deutscher Chemiker, 10th Conference, Photochemical Group, Wurzburg (FRG), Nov. 20, 1987, pp. 23–25, U. Kogelschatz, et al., "Neue UV-Und Vuv-Excimerstrahler".

Patent Abstracts of Japan, vol. 10, No. 8, (E-373) (2065), Jan. 14, 1986, & JP, A, 60-172135, Sep. 5, 1985, T. Kajiwara, "Flat Plate Light Source".

Display Devices, edited by J. I. Pankove, Springer-Verlag, 12/1980 (Berlin, Heidelberg, New York), pp. 90–127, T. N. Criscimagna, et al., "AC Plasma Display".

*Primary Examiner*—Donald J. Yusko
*Assistant Examiner*—John E. Giust
*Attorney, Agent, or Firm*—Oblon, Spivak, McClelland, Maier & Neustadt

[57] ABSTRACT

In a UV high-power radiator, the electrodes (6', 6'') consist of wires embedded in a glass dielectric (3). The dielectric is arranged spaced between two UV-transparent sheets (1, 2). The discharge spaces (8, 9) are filled with a filler gas emitting radiation under discharge conditions. The surface discharges (10) form on the dielectric surface in each case between two adjacent electrode wires (6', 6''). A high-power radiator constructed in this manner is characterized by simple and economical construction and high UV yield.

12 Claims, 2 Drawing Sheets

HIGH-POWER RADIATOR

BACKGROUND OF THE INVENTION

1. Field of the Invention

The invention relates to a high-power radiator, in particular for ultraviolet light, having a discharge space filled with filler gas emitting radiation under discharge conditions, having electrode pairs which are connected in pairs to the two poles of a high-voltage source, at least one dielectric material which adjoins the discharge space lying between two electrodes at different potentials.

In this respect, the invention is related to a prior art as emerges, for instance, from the EP Application 87109674.9 or the U.S. Pat. No. 4,837,484.

2. Discussion of Background

The industrial use of photochemical processes greatly depends on the availability of suitable UV sources. The classic UV radiators supply low to medium UV intensities at some discrete wavelengths, such as, for example, the low-pressure mercury lamps at 185 nm, and especially at 254 nm. Truly high UV power is obtained only from high-pressure lamps (Xe, Hg), which then distribute their radiation over a greater range of wavelengths. The new excimer lasers have provided some new wavelengths for photochemical basic experiments, but at present are really only suitable in exceptional cases for an industrial process for cost reasons.

A new excimer radiator is described in the initially mentioned EP Patent Application, or also in the conference publication "Neue UV- und VUV-Excimerstrahler" (New UV and VUV Excimer Radiators) by U. Kogelschatz and B. Eliasson, distributed at the 10th conference of the Gesellschaft Deutscher Chemiker (Society of German Chemists), Photochemical Group, in Würzburg (FRG), 18–20th Nov. 1987. This new type of radiator is based on the fact that excimer radiation can be produced even in dark electrical discharges, a type of discharge which is used on an industrial scale in the generation of ozone. In the current filaments of this discharge, which are present only briefly (<1 microsecond), noble gas atoms are excited, by electron impact, which further react to excited molecule complexes (excimers). These excimers live for only a few 100 nanoseconds and, when they decay, output their bonding energy in the form of UV radiation.

The construction of an excimer radiator of this type essentially corresponds to that of a classic ozone generator, right down to the power supply, with the essential difference that at least one of the electrodes and/or dielectric layers delimiting the discharge space is transmissive for the radiation generated.

SUMMARY OF THE INVENTION

Accordingly, one object of this invention is to provide a novel high-power radiator, in particular for UV or VUV light, which is characterized in particular by comparatively high efficiency, can be produced economically, and also permits the construction of very large plane radiators.

To achieve this object for a high-power radiator of the generic type mentioned at the beginning, the invention provides that the aforesaid electrode pairs, separated by dielectric material, are arranged immediately adjacent to one another in such a way that the dark electrical discharge in the discharge space forms in the region of the surface of the dielectric.

When a voltage is applied, a multiplicity of surface discharges forms from one electrode through the dielectric essentially along the surface of the dielectric and into the dielectric again to the neighboring electrode.

These discharges radiate the usable UV light, which then penetrates, for example, through the wall delimiting the discharge space. In contrast to the known configurations, here the entire extent of the discharge channels is utilized for generating radiation.

The production of the high-power radiator according to the invention is more simple and less expensive than with the known radiators. Materials which can be readily cast can be used, so that the electrodes can be cast in. Consequently problems relating to compliance with tolerances (e.g. thickness of the dielectric or the spacings) are reduced. For the delimiting glass/quartz material, too, very high demands are not necessary since the delimiting walls need only be transparent and are not stressed by the discharge. This leads to a longer service life of the radiator. The gap width and its tolerances are far less critical too. In particular, owing to the lower requirements as regards tolerances, it is now possible to realize very large plane radiators which can be of a very thin design.

Due to the fact that virtually the entire length of the discharge space contributes to emission, the UV yield is very high. Transmission losses of an electrode grid or a partially transmissive layer do not occur.

The high-power radiator according to the invention permits radiator geometries of virtually any design. Besides plane radiators, which radiate to one or to both flat sides, cylindrical or elliptical radiators can be produced. Also, the radiators need not necessarily be plane or elongated, but may be curved or bent in one or more dimensions.

Of course, analogously to the Swiss Patent Application No. 152/88-7 of the applicant of 15.1.1988, the invention allows the walls delimiting the discharge space, either on the wall facing the discharge space or the external wall, to be provided with a luminescent layer for converting the UV light into visible light. In the case of the first alternative, it is then no longer necessary for the wall to be UV-transmissive because it now only has to transmit visible light.

Dielectrics which are not necessarily transparent for UV light can be used in the arrangement according to the invention, which allows a particularly high degree of efficiency to be expected for particular applications. Thus, in particular, the UV light can be used directly for some applications without it having to leave the discharge space. This applies in particular to such applications which can be carried out in the discharge space. Such applications of increasing economic importance include, for example, the use as powerful UV radiator for pre-ionization purposes of other discharges, e.g. laser, treatment of surfaces with UV illumination, chemical processes such as the preparation of new chemicals or surfaces and coating techniques such as plasma-CVD (chemical vapor deposition), photo-CVD, in which a substrate to be treated is brought as close as possible to the UV light source in a suitable filler gas. The particular advantages of such an "internal" arrangement are, inter alia, the avoidance of absorption losses through windows and the utilization of additional effects through the discharge itself.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
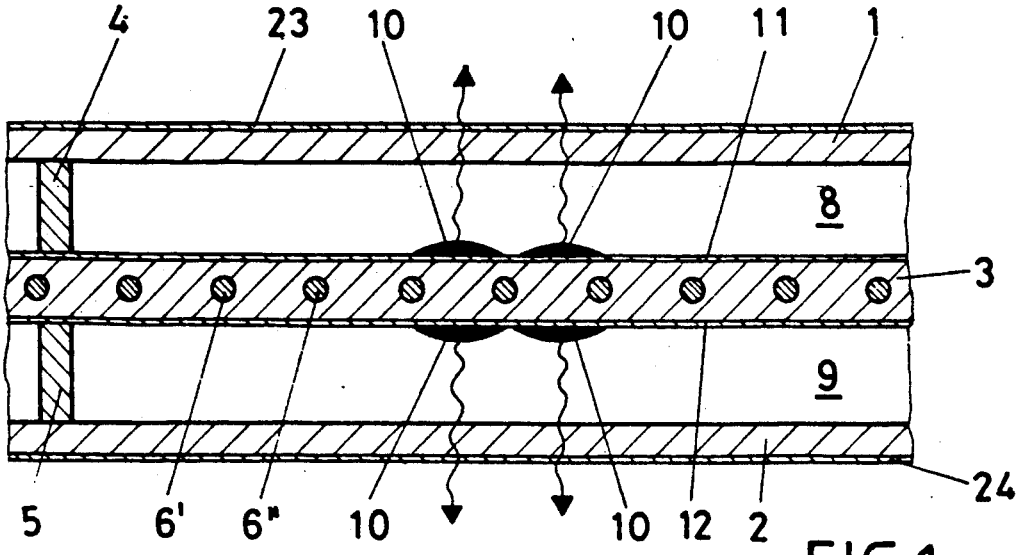
FIG. 1 shows a cross-section of a first exemplary embodiment of a plane radiator with double-sided radiation.
Figure 2:
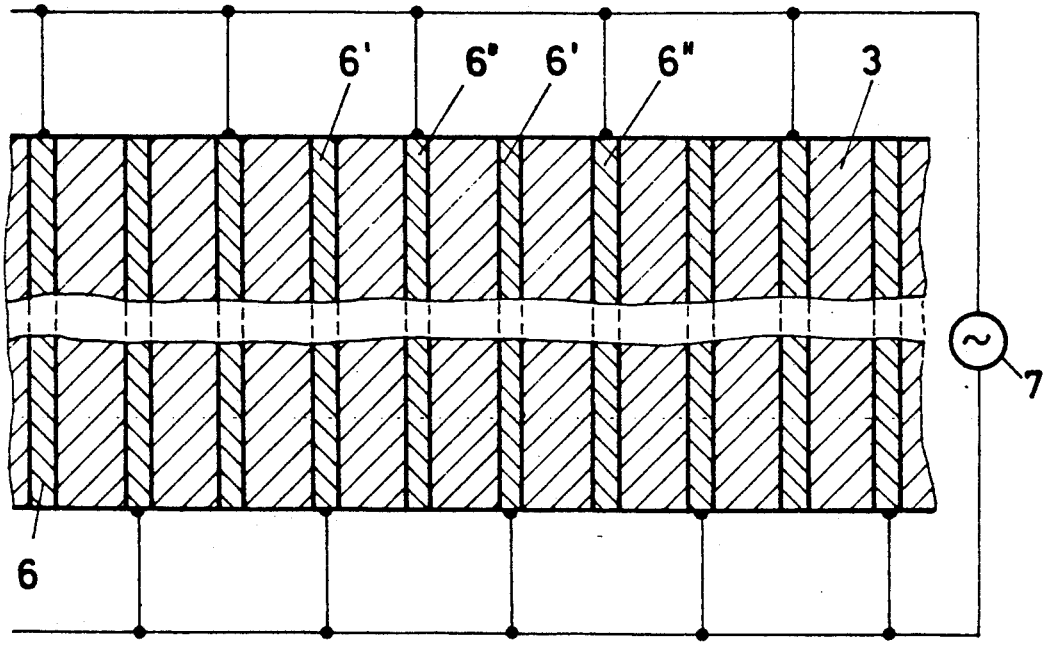
FIG. 2 shows a longitudinal section of the plane radiator according to FIG. 1, with a diagrammatic representation of the electrical supply.

Referring now to the drawings, wherein like reference numerals designate identical or corresponding parts throughout the several views, in FIGS. 1 and 2 the plane radiator consists of two spaced UV-transmissive sheets 1, 2 made of quartz glass, between which a further sheet 3 of dielectric material, e.g. glass or ceramic or a plastics dielectric, is arranged. Spacers 4, 5 distributed over the surface ensure that distance is maintained between the sheets 1, 2 and 3, and serve at the same time to hold them together. Metal electrodes 6', 6'' are embedded in the sheet 3 at regular intervals, and spaced from one another. As can be seen in FIG. 2, the electrodes 6', 6'' are alternately connected to the one and to the other pole of an alternating-current source 7. The alternating-current source 7 corresponds in principle to that used for feeding ozone generators. Typically, it supplies a settable alternating-current voltage in the order of several 100 volts to 20,000 volts at frequencies in the range of the technical alternating current up to several kHz—depending on the electrode geometry, pressure in the discharge space and composition of the filler gas.

The discharge spaces 8 and 9 between the sheets 1 and 3, and 3 and 2, are filled with a filler gas emitting radiation under discharge conditions, e.g. mercury, noble gas, noble gas/metal vapor mixture, noble gas/-halogen mixture, if appropriate including an additional further noble gas, preferably Ar, He, Ne, as buffer gas.

Depending on the desired spectral composition of the radiation, in this connection a substance/substance mixture in accordance with the following table can be used:

| Filler gas | Radiation |
|---|---|
| Helium | 60–100 nm |
| Neon | 80–90 nm |
| Argon | 107–165 nm |

-continued

| Filler gas | Radiation |
|---|---|
| Argon + Fluorine | 180–200 nm |
| Argon + Chlorine | 165–190 nm |
| Argon + Krypton + Chlorine | 165–190, 200–240 nm |
| Xenon | 160–190 nm |
| Nitrogen | 337–415 nm |
| Krypton | 124, 140–160 nm |
| Krypton + Fluorine | 240–255 nm |
| Krypton + Chlorine | 200–240 nm |
| Mercury | 185, 254, 320–360, 390–420 nm |
| Selenium | 196, 204, 206 nm |
| Deuterium | 150–250 nm |
| Xenon + Fluorine | 400–550 nm |
| Xenon + Chlorine | 300–320 nm |

In addition, a whole range of further filler gases are possible:

- a noble gas (Ar, He, Kr, Ne, Xe) or Hg with a gas or vapor from $F_2$, $I_2$, $Br_2$, $Cl_2$ or a compound, which in the discharge splits off one or more atoms F, I, Br or Cl;
- a noble gas (Ar, He, Kr, Ne, Xe) or Hg with $O_2$ or a compound, which in the discharge splits off one or more O atoms;
- a noble gas (Ar, He, Kr, Ne, Xe) with Hg.

In the electrical surface discharge forming, the electron energy distribution can be optimally set by the thickness of the dielectric sheet 3 and its properties, distance between the electrodes 6', 6'', pressure and/or temperature.

When a voltage is applied between in each case two adjacent electrodes 6', 6'' a plurality of discharge channels 10 are formed from one electrode 6' through the dielectric 3 along the surface of the dielectric 3 and into the dielectric 3 again to the adjacent electrode 6''. These surface discharges 10 running along the surface radiate the UV light which then penetrates through the sheets 1, 2 which are transparent in the example. If different filler gases are used in the spaces 8 and 9, then two different radiations can be generated with one and the same radiator by suitably selecting the electrode arrangement and distribution. By applying a coating 11, 12 to the two surfaces of the dielectric 3, lower firing voltages can be achieved for the discharge so that the costs for the feeding can be reduced. Suitable coating materials are above all the oxides of magnesium, ytterbium, lanthanum and cerium (MgO, $Yb_2O_3$, $La_2O_3$, $CeO_2$).

It is also possible to use the UV light directly for some applications without it having to penetrate the cover sheets 1, 2. This applies to such applications which can be carried out in the discharge spaces 8, 9 themselves. Such applications with increasing economic importance include, for example, the treatment of surfaces with UV exposure, chemical processes such as the preparation of new chemicals or surface-coating such as plasma-CVD, photo-CVD, that is to say processes in which a substrate to be treated is brought as close as possible to the dielectric surface, that is where the radiation is produced, in a suitable filler gas.

The particular advantages of such an "internal" arrangement are, inter alia, the avoidance of absorption losses (through the sheets 1, 2) and the utilization of additional effects through the discharge itself, the electrical properties of the substrate to be treated being relatively insignificant.

The production of the dielectric 3 complete with the electrodes 6', 6'' embedded in it is, in comparison to the known high-power radiators, simplified and is thus less expensive. Materials can be used which can be cast comparatively simply, so that the electrodes 6', 6" can be cast in at the same time. This reduces problems as regards the compliance with tolerances, e.g. the thickness of the dielectric 3 or the spacings between the sheets 1 and 3, and 3 and 2. In addition, no great demands need be made of the material for the UV-transmissive sheets—insofar as they need to be UV-transmissive at all—since they are not stressed by the discharge. This in turn leads to an increase in the overall service life of the radiator.

It is also possible to employ techniques used in the production of plasma-display cells (cf. "AC Plasma Display" by T. N. Criscimagna & P. Pleshko in "Display Devices", J. I. Pamkove (Ed.), Springer-Verlag Berlin, Heidelberg, N.Y. 1980, p. 92–150) for an inexpensive production of the electrodes 6', 6" embedded in the dielectric 3.

Figure 3:
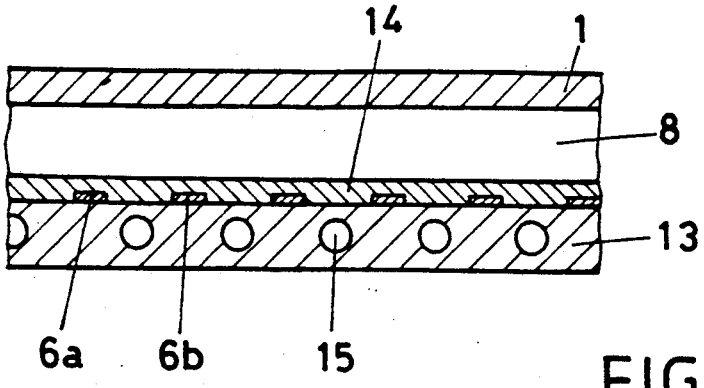
FIG. 3 shows a first variation of the plane radiator according to FIGS. 1 and 2 with single-sided radiation and electrodes that are placed on a substrate and are coated with a dielectric layer.

Instead of metallic wires 6', 6" according to FIG. 1, the electrodes according to FIG. 3 are applied as discrete conductor tracks, 6a, 6b on a substrate 13 of glass, quartz or ceramic by means of thin-film or thick-film techniques. On the one hand vapor deposition and sputter processes are used for metallizing here, and on the other hand conductive pastes. Fine conductor tracs can be produced by photolithographic methods, wider ones (>25 micrometers) can be produced by metal deposition through a mask. The conductor tracks (electrodes) applied in this manner are then covered by a dielectric layer 14. Thus, it is possible to apply, for example, layers of lead oxide glass as a spray or paste and subsequently heat them to produce a continuous glass layer. Layers of borosilicate glass can be produced with vapor deposition techniques. It is also possible for other dielectric layers to be deposited with methods common in semiconductor technology, e.g. by means of plasma-CVD or photo-CVD.

Without going beyond the scope of the invention, a wide range of modifications of the UV high-power radiator described above are possible, which will be discussed below.

Thus, instead of two discharge spaces 8, 9, only one discharge space may be provided. For this, it must be ensured that the surface discharges form only in the other space by providing a suitable insulation, e.g. sulfur hexafluoride or water, in the one space or a different geometry of the dielectric and/or the electrodes, for example one according to FIG. 3.

Instead of round electrodes 6', 6" according to FIG. 1, it is also possible to use electrodes with virtually any cross-section. It is also not necessary for the electrodes to be linear, rather they may also be arranged next to one another in a meander fashion or in a zig-zag, for example.

To improve the heat removal from the dielectric, it is possible to design the electrodes 6', 6" as hollow electrodes, or to additionally provide in the dielectric 3 in FIG. 1 or in the substrate 13 in FIG. 3 channels (Pos. 15 in FIG. 3) extending in the longitudinal direction of the electrodes, through which channels a liquid or gaseous cooling agent is conveyed.

Figure 5:
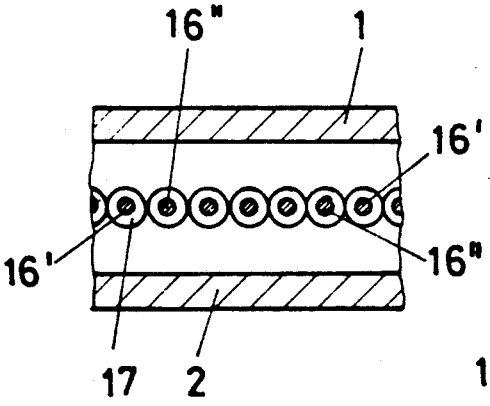
FIG. 5 shows a third variation of the plane radiator according to FIGS. 1 and 2 with individual electrodes surrounded by dielectric material.
Figure 4:
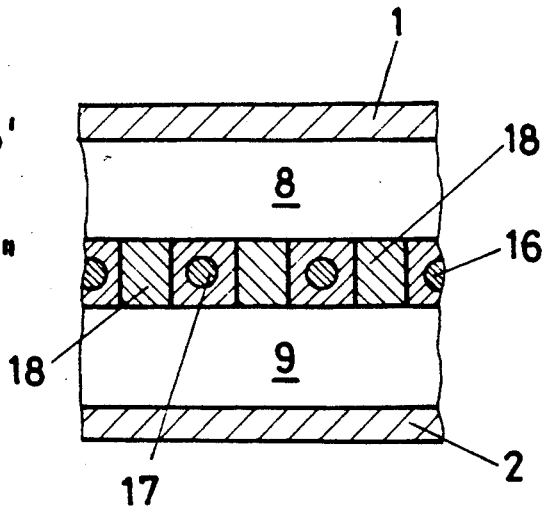
FIG. 4 ,shows a second variation of the plane radiator according to FIGS. 1 and 2 with non-homogeneous dielectric.

Besides individual electrodes embedded in a plane dielectric 3 or 14, it is additionally possible in accordance with FIGS. 4 and 5 to use individual wires 16', 16" each having a dielectric enclosure 17, which are arranged between the two sheets 1 and 2 either close together (FIG. 5), openly next to one another or spaced from one another by means of intermediate layers 18 or spacers.

Figure 6:
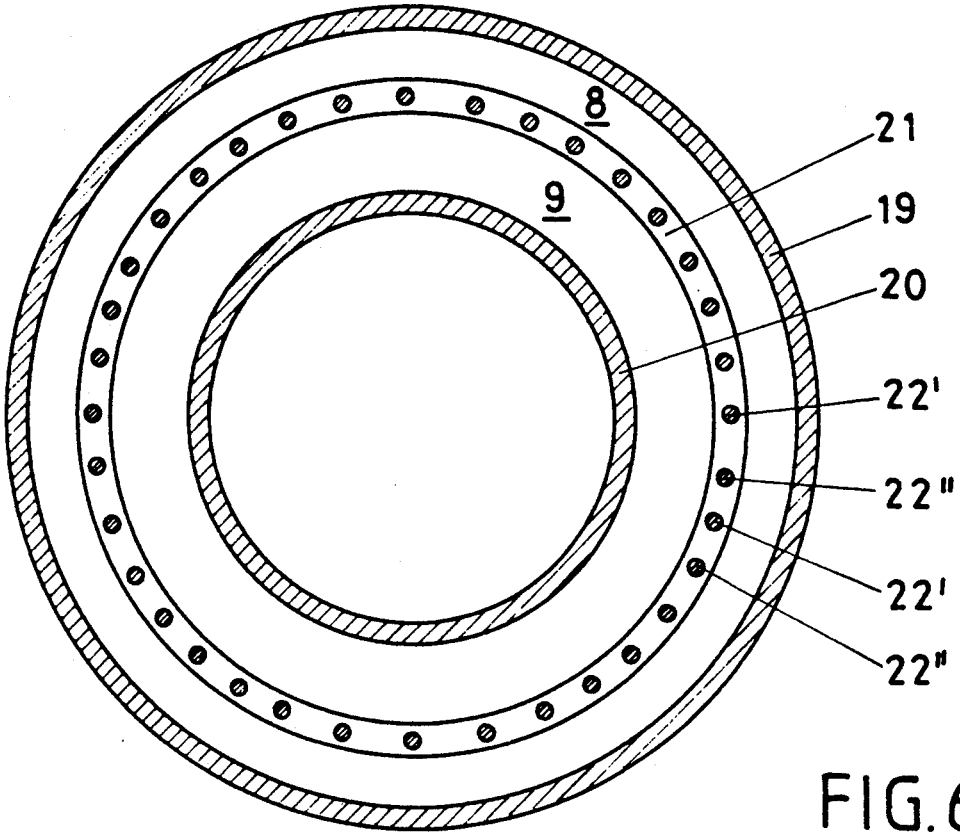
FIG. 6 shows a cross-section of an exemplary embodiment of the invention in the form of a cylindrical radiator.

Instead of plane radiators according to FIGS. 1 to 5, cylindrical radiators are also possible, as is illustrated in FIG. 6. In the latter, a tube 21 of dielectric material is arranged coaxially between two quartz tubes 19, 20. Spacers (not shown) maintain the mutual position of the three tubes. Analogous to FIG. 1, there are embedded in the dielectric tube 21 metal electrodes 22', 22" which, analogous to FIG. 2, are alternately connected to the one and to the other pole of an alternating-current source (not shown).

In the case of the example, the cylindrical radiator according to FIG. 6 radiates both inwardly (into the interior of the tube 20) and outwardly. If different filler gases are used in the spaces 8 and 9, two different radiations can be produced with one and the same radiator by suitable selection of the electrode arrangement and distribution. This is also true, of course, for a radiator according to FIG. 4.

As already described in connection with FIG. 1, the desired reactions may also take place in the discharge space(s) 8 or 9 themselves with cylindrical radiators according to FIG. 6.

The above description of exemplary embodiments of the invention concentrated on the generation of UV and VUV radiation. By coating the sheets 1, 2 or the tubes 19, 20 with a luminescent layer 23, 24 (FIG. 1), analogous to the technology known for luminescent tubes for illumination purposes, visible light of high power can also be produced. Such layers are known and may also be applied to the inner surfaces of the sheets 1, 2, adjoining the discharge space 8 or 9, or of the tubes 19, 20. In the latter case, these sheets or tubes need no longer be UV-transmissive, but only transparent for visible light.

Obviously, numerous modifications and variations of the present invention are possible in the light of the above teachings. It is therefore to be understood that within the scope of the appended claims, the invention may be practiced otherwise than as specifically described herein.

What is claimed as new and desired to be secured by letters patent of the United States is:

1. A high-power radiator, in particular for ultraviolet light, having a discharge space, delimited by walls and filled with filler gas emitting radiation under discharge conditions, having electrode pairs which are connected in pairs to the two poles of a high-voltage source, at least one dielectric material which adjoins the discharge space lying between two electrodes at different potentials, wherein the aforesaid electrode pairs, spatially separated from said walls and separated from each other by dielectric material, are arranged adjacent to one another in such a way that the electrical discharge in the discharge space forms essentially only in the region of the surface of the dielectric.

2. A high-power radiator as claimed in claim 1, wherein the electrodes are embedded in the dielectric material and adjacent electrodes are in each case connected to different poles of the high-voltage source.

3. A high-power radiator as claimed in claim 2, wherein all electrodes are embedded in a common carrier made of dielectric material.

4. A high-power radiator as claimed in claim 2, wherein the electrodes are each individually surrounded by a dielectric enclosure.

5. A high-power radiator as claimed in claim 1, wherein the electrodes are arranged on a substrate made of insulating material and are covered by a dielectric layer.

6. A high-power radiator as claimed in one of claims 1 to 5, wherein cooling channels extending in the longitudinal direction of the electrodes are provided in the electrodes or in the material in which said electrodes are embedded or on which said electrodes are arranged.

7. A high-power radiator as claimed in one of claims 1 to 5, wherein there is provided on the surface of the dielectric facing the discharge space an additional layer for reducing the firing voltage of the electrical surface discharge.

8. A high-power radiator as claimed in one of claims 1 to 5, wherein, for generating radiation with several different wavelengths in one discharge space, a filler gas with at least two noble gases and at least one non-noble gas is provided.

9. A high-power radiator as claimed in one of claims 1 to 5, wherein filler gases of different composition are provided in the two discharge spaces.

10. A high-power radiator as claimed in one of claims 1 to 5, wherein the walls delimiting the discharge space (8, 9) are provided with a luminescent layer (23, 24).

11. A high-power radiator as claimed in claim 7, wherein said additional layer comprises a layer of an oxide of magnesium, ytterbium, lanthanum or cerium.

12. A high-power radiator as claimed in claim 10, wherein the walls delimiting the discharge space are tubular in shape.

* * * * *